US006325302B1

(12) United States Patent
Guzowski et al.

(10) Patent No.: US 6,325,302 B1
(45) Date of Patent: Dec. 4, 2001

(54) AIRLESS SPRAY TOOL

(75) Inventors: Raymond J. Guzowski, Fenton; David W. Lazar, Troy; James W. Ingles, White Lake, all of MI (US)

(73) Assignee: Fanuc Robotics North America, Inc., Rochester Hills, MI (US)

( * ) Notice: Subject to any disclaimer, the term of this patent is extended or adjusted under 35 U.S.C. 154(b) by 0 days.

(21) Appl. No.: 09/451,234

(22) Filed: Nov. 29, 1999

(51) Int. Cl.[7] ..... B05B 1/24; B05B 1/14

(52) U.S. Cl. ..... 239/132; 239/128; 239/132.1; 239/132.3; 239/548; 239/550; 239/551; 239/560; 239/556; 239/583; 239/562; 239/DIG. 14; 901/43

(58) Field of Search ..... 239/128, 132, 239/132.1, 132.3, 548, 550, 551, 556, 559, 583, 562, 584, DIG. 14, 560, 561; 901/43

(56) References Cited

U.S. PATENT DOCUMENTS

| | | | | |
|---|---|---|---|---|
| 3,301,488 | * | 1/1967 | Norris | 239/551 X |
| 3,570,725 | * | 3/1971 | Baker et al. | 239/551 X |
| 4,125,035 | | 11/1978 | Dooley . | |
| 4,679,734 | | 7/1987 | Mommsen et al. . | |
| 4,692,358 | * | 9/1987 | Marsden et al. | 901/43 X |
| 4,738,400 | * | 4/1988 | Irwin | 239/551 X |
| 4,747,541 | * | 5/1988 | Morine et al. | 239/562 X |
| 4,760,961 | * | 8/1988 | Nagai | 239/560 X |
| 5,201,466 | | 4/1993 | Hynds . | |
| 5,372,856 | | 12/1994 | Ogasawara . | |
| 5,514,420 | | 5/1996 | Tsuzuki et al. . | |
| 5,547,129 | * | 8/1996 | Fortunato et al. | 239/132.3 |
| 5,660,635 | | 8/1997 | Jacques . | |
| 5,816,505 | | 10/1998 | Tran et al. . | |

* cited by examiner

*Primary Examiner*—Robin O. Evans
(74) *Attorney, Agent, or Firm*—Howard & Howard

(57) ABSTRACT

A spray assembly for applying material to an object is provided. The assembly includes a plurality of spray nozzles each having spray openings for applying material to the object. Four nozzles are provided having two orientations each orientation with two spray widths. The assembly also includes a plurality of valves for controlling the flow of material through each of the spray openings. A manifold supports the plurality of spray nozzles and the valves and defines a feed bore and a spray bore extending between the feed bore and each of the nozzles. Water passages are integral with the manifold to regulate the temperature of the material flowing through the spray bores.

8 Claims, 3 Drawing Sheets

AIRLESS SPRAY TOOL

BACKGROUND OF THE INVENTION

1. Field of the Invention

The present invention relates to a spray assembly for applying material to an object, or more specifically, to a spray assembly for use with a robot for applying material to areas of various shapes and sizes.

2. Description of the Prior Art

Airless spray tools are used to apply materials, such as sound deadener, to areas of an object, such as the floor pan, underbody, engine compartment, and wheel wells of a vehicle. Typically, the material is applied using a spray assembly mounted on a robot arm. The robot moves the spray assembly through a programmed path to apply the material to the desired area. These areas have varying shapes and sizes with uneven surfaces, and therefore, are difficult to cover efficiently.

Spray guns, or spray nozzles, produce a flat, fan-like pattern having a width that may be oriented in a particular direction. Typically, the prior art spray assemblies have a pair of spray guns having different spray width that are oriented in the same direction. Prior art spray assemblies have utilized individual spray guns that are plumbed together by hoses or supplied with material by individual hoses. The multiple spray guns and hosing are mounted on a bracket, which yields a bulky arrangement. The spray guns are independently actuateable depending on the width of material desired for the particular area. Depending on the shape of the area where the material is to be applied, it may be more efficient to change the orientation of spray pattern. However, since the spray guns are oriented in the same direction, the robot must reorient the gun when a different orientation is desired which increases the time it takes to apply material to the object. Therefore, what is needed is a more compact spray assembly that is capable of applying material to an object more efficiently.

SUMMARY OF THE INVENTION AND ADVANTAGES

The present invention provides a spray assembly for applying material to an object. The assembly includes a plurality of spray nozzles each having spray openings for applying material to the object. The assembly also includes a plurality of valves for controlling the flow of material through each of the spray openings. A manifold supports the plurality of spray nozzles and the valves and defines a feed bore and a spray bore extending between the feed bore and each of the nozzles. In the preferred embodiment of the present invention, four nozzles are provided having two orientations each with two spray widths.

Accordingly, the present invention provides a compact spray assembly with fewer parts capable of more efficient material application to an object.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
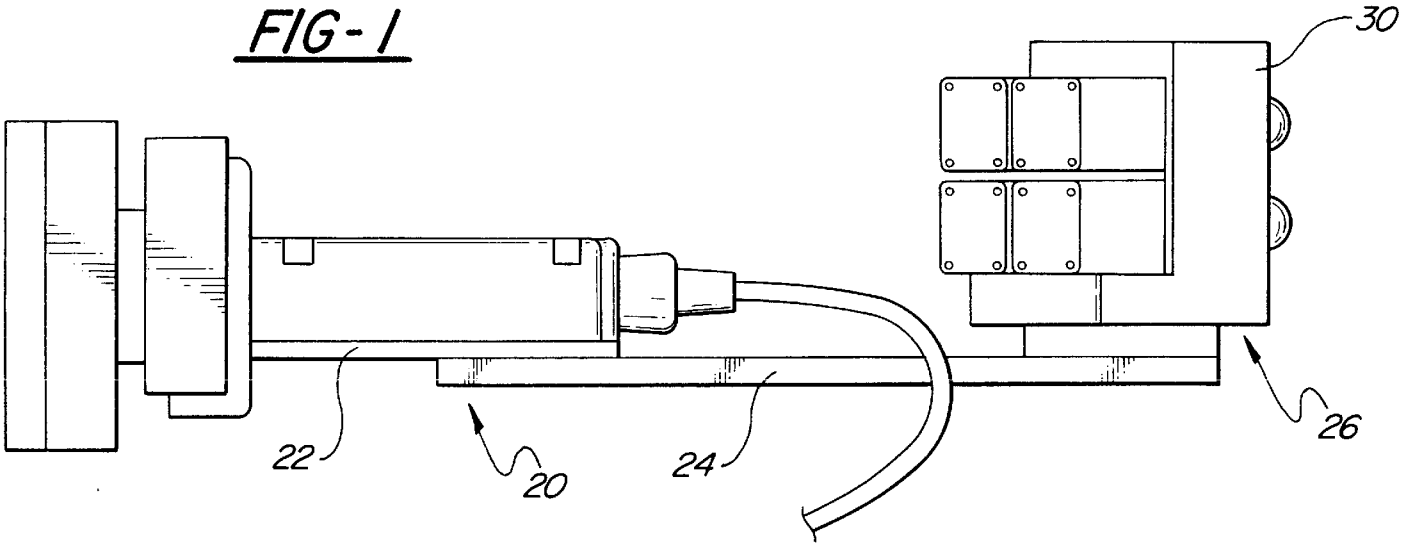
FIG. 1 is a top elevational view of a robot having a spray assembly according to the present invention.
Figure 2:
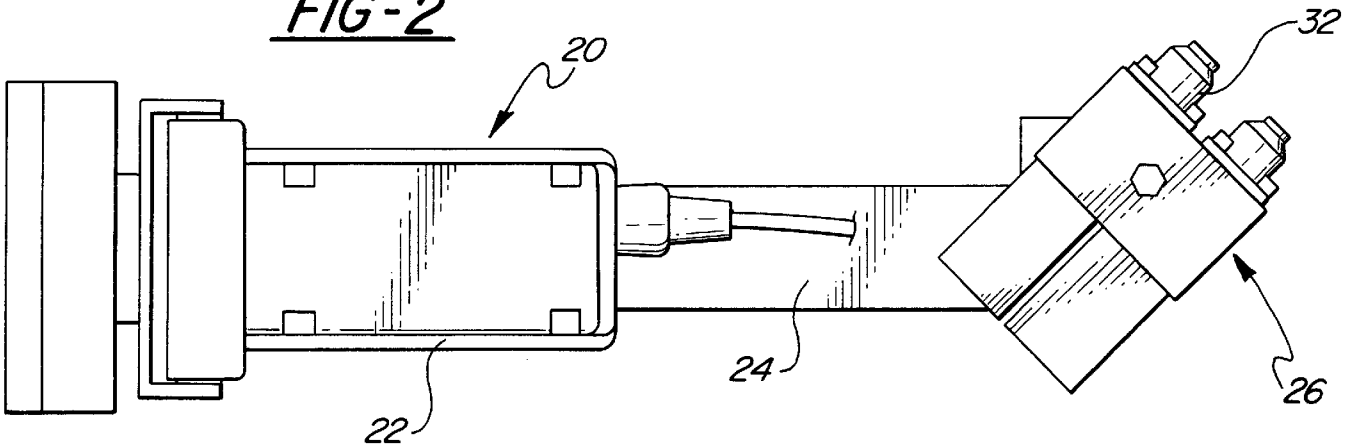
FIG. 2 is a side elevational view of the robot and spray assembly shown in FIG. 1.
Figure 4:
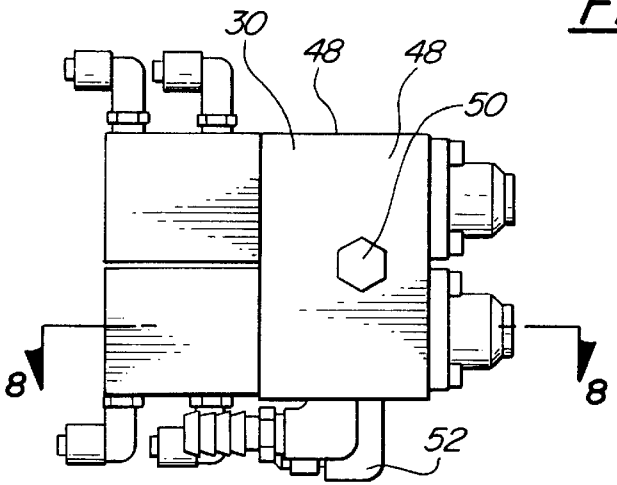
FIG. 4 is a top elevational view of the spray assembly shown in FIG. 3.
Figure 6:
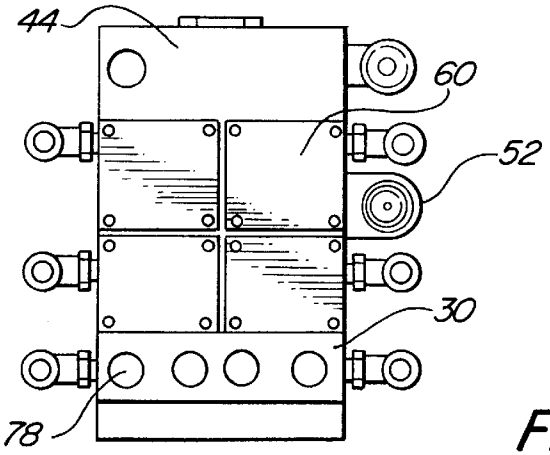
FIG. 6 is a rear elevational view of the spray assembly shown in FIG. 3.
Figure 3:
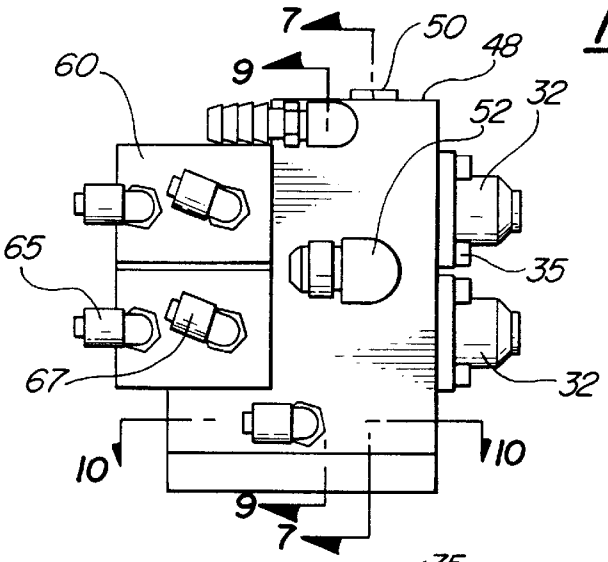
FIG. 3 is a side elevational view of the spray assembly of the present invention.
Figure 5:
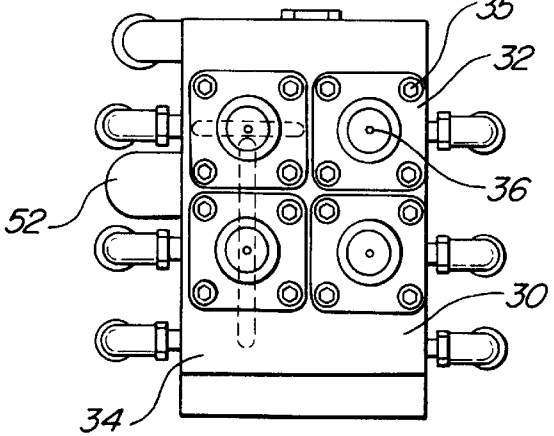
FIG. 5 is a front elevational view of the spray assembly shown in FIG. 3.

Referring to the Figures, wherein like numerals indicate like or corresponding parts throughout the several views, a robot is generally shown at 20 having an arm 22 with a bracket 24 in FIGS. 1 and 2. The present invention spray assembly 26 is mounted to the bracket 24. The robot 20 moves the spray assembly 26 through a path for applying the material to a desired area of an object (not shown). Various supply and return hoses are connected to the spray assembly 26, but are not shown for clarity.

Referring to FIGS. 3–6, the spray assembly 26 has a manifold 30 with a plurality of spray nozzles 32 secured to a front surface 34 of the manifold 30 by fasteners 35. Each spray nozzle 32 has a spray opening 36 for producing a spray pattern for applying material to the object. The spray patterns are indicated bye broken lines in FIG. 5. Preferably, there are four nozzles 32, as shown in the FIG. 5, with a pair nozzles oriented in one direction and the other pair of nozzles oriented in a direction perpendicular to the one direction. Material is sprayed from the spray openings 36 in a flat, fan-like spray pattern, as is shown in the art. One nozzle in each pair has a narrow spray pattern, such as 4 inches wide, whereas the other nozzle in each pair has a wider spray pattern, such as 8 inches wide. In this manner, material may be applied to the object in one of the two spray width in one of the two spray orientations resulting in more efficient application of the material because the robot 20 need not orient the spray assembly 26. It is to be understood that the nozzles 32 may produce any spray pattern oriented in any direction.

Figure 8:
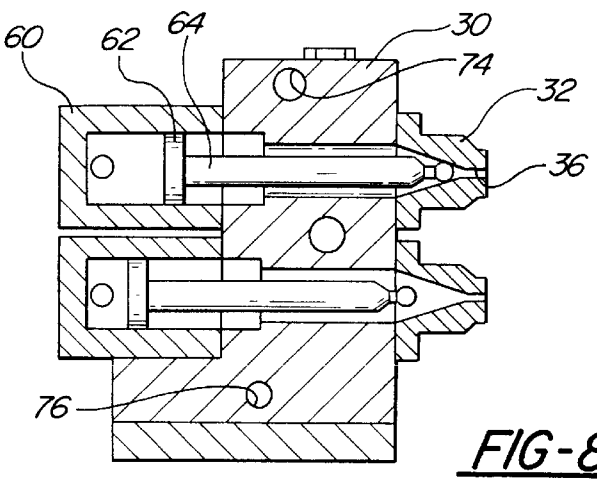
FIG. 8 is a cross-sectional view taken along line 8—8 in FIG. 4.
Figure 7:
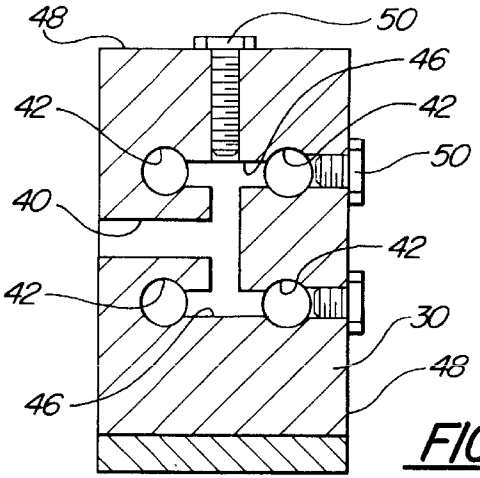
FIG. 7 is a cross-sectional view taken along line 7—7 in FIG. 3.

The manifold 30 defines a feed bore 40 and a spray bore 42 extending between the feed bore 40 and each of the nozzles 32, as shown in FIGS. 7 and 8. It can be appreciated that the manifold 30 of the present invention provides a compact arrangement by incorporating integral bores 40, 42. Four spray bores 42 extend from the front surface 34 to a rear surface 44 of the manifold 30. The spray bores 42 are fluidly interconnected by feed passages 46 that are drilled into the manifold 30 from sides 48. Plugs 50 are used to close of the passages 46 and prevent material from escaping the manifold 30. The feed bore 40 is fluidly interconnected to the a portion of the passages 46 to provide material to all of the nozzles 32. A fitting 52 having a supply hose (not shown) provides material to the feed bore 40. Preferably, a single feed bore 40 is used to reduce the number of hoses and provide a more compact arrangement. However, it is to be understood that more than one feed bore 40 may be used and that the feed bore 40 may be fluidly interconnected to a different portion of the passages 46 or spray bores 42.

The rear surface 44 of the manifold 30 supports a plurality of housings 60 each having a valve 62 for controlling the flow of material through each of the spray openings 36. Specifically, each of the valves is interposed between the feed bore 40 and each of the spray bores 42 for individual selective control of the flow of material from each of the spray openings 36. The valves 62 include an air-actuated piston 64 having open and closed positions for controlling the flow of material to the one of the spray bores. Pneumatic lines 65, 67 are connected to the housing 60 and actuate the piston 64. The open position permits the flow of material from the feed bore 40 to the one of the spray bores 42. Conversely, the closed position prevents the flow of material from the feed bore 40 to the one of the spray bores 42.

Typically, one valve is opened for applying a desired spray pattern in a desired orientation depending on the particular area to be covered, while the other valves are closed. The valves 62 are actuated to vary the coverage as the robot 20 moves the spray assembly 26 through the desired path. In this manner, a plurality of coverages may be achieved by selectively actuating the valves 62 controlling flow through the four spray nozzles 32.

Figure 10:
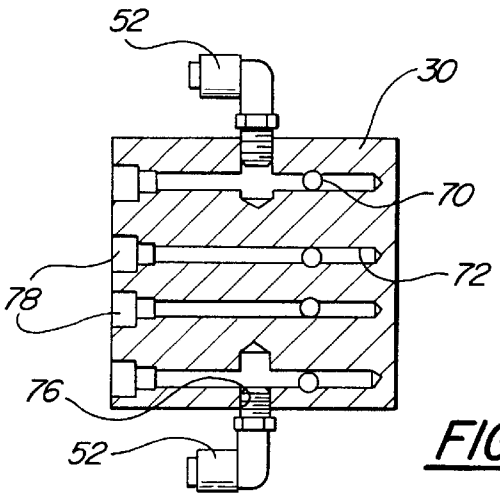
FIG. 10 is a cross-sectional view taken along line 10—10 in FIG. 3.
Figure 9:
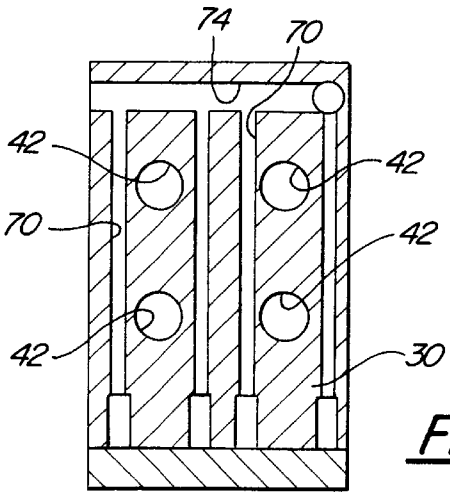
FIG. 9 is a cross-sectional view taken along line 9—9 in FIG. 4.

Referring to FIGS. 9 and 10, the manifold 30 further includes a plurality of water passageways 70, 72 adjacent to the spray bores 42 for controlling the temperature of the material in the spray bores 42. By controlling the temperature more consistent application of the material to the object may be achieved. The water passageways 70, 72 include a first set of passageways 70 arranged transverse to the spray bores 32 and second set of passageways 72 in communication with the first set of passageways 70 arranged generally parallel with the spray bores 32. Plugs 78 are used to seal opening created when forming passageways 70, 72. At least one water inlet 74 is in fluid communication with the water passageways 70, 72 for supplying water to the water passageways 70, 72. At least one water outlet 76 is in communication with the water passageways 70, 72 for permitting the water to exit the water passageways 70, 72 in the manifold 30 and circulating the temperature controlled water. In this manner, the present invention provides a compact spray assembly 26 in which the temperature of the material may be controlled.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A spray assembly for applying material to an object, said assembly comprising:

a plurality of spray nozzles each having a spray opening for applying material to the object wherein at least one of said spray nozzles is different from another of said spray nozzles such that said spray nozzles cooperate to provide at least two spray patterns in at least two different spray orientations;

a plurality of valves interconnected with each of said spray nozzles, said valves being selectively actuated to control the flow of material through each of said spray openings associated with each of said spray nozzles;

a common manifold supporting said plurality of spray nozzles and said plurality of valves, said common manifold defining a feed bore and a spray bore extending between said feed bore and each of said spray nozzles; and at least one of said spray nozzles being arranged non-linearly on said common manifold relative to another two of said spray nozzles.

2. An assembly set forth in claim 1 wherein each of said valves is interposed between said at least one feed bore and one of said spray bores for individual selective control of the flow of material from each of said spray openings.

3. An assembly as set forth in claim 2 wherein said valves include an air actuated piston having open and closed positions for controlling the flow of material to said one of said spray bores, said open position permitting the flow of material from said feed bore to said one of said spray bores and said closed position preventing the flow of material from said feed bore to said one of said spray bores.

4. An assembly as set forth in claim 3 wherein a first of said spray nozzles has a first spray pattern and a second of said spray nozzles has a second spray pattern for achieving a plurality of coverages by selectively actuating said valves controlling flow through said first and second spray nozzles.

5. An assembly as set forth in claim 1 wherein said spray nozzles comprise four spray nozzles cooperating to provide two spray widths in each of said at least two different spray orientations for applying the material to the object in one of said two spray widths and in one of said at least two different spray orientations.

6. An assembly as set forth in claim 5 including a robot and said assembly is supported on said robot for moving said assembly through a path for applying the material to the object, said valves actuated to vary said coverage as said robot moves said assembly through said path.

7. An assembly as set forth in claim 1 wherein said manifold further includes a plurality of water passageways adjacent to said spray bores for controlling the temperature of the material in said spray bores, at least one water inlet in fluid communication with said water passageways for supplying water to said water passageways, and at least one water outlet in communication with said water passageways for permitting the water to exit said water passageways in said manifold.

8. An assembly as set forth in claim 7 wherein said water passageways include a first set of passageways arranged transverse to said spray bores and second set of passageways in communication with said first set first of passageways arranged generally parallel with said spray bores.

* * * * *